US007620544B2

(12) United States Patent
Woo

(10) Patent No.: US 7,620,544 B2
(45) Date of Patent: Nov. 17, 2009

(54) METHOD AND APPARATUS FOR DETECTING SPEECH SEGMENTS IN SPEECH SIGNAL PROCESSING

(75) Inventor: Kyoung-Ho Woo, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 801 days.

(21) Appl. No.: 11/285,270

(22) Filed: Nov. 21, 2005

(65) Prior Publication Data

US 2006/0111901 A1 May 25, 2006

(30) Foreign Application Priority Data

Nov. 20, 2004 (KR) ..... 10-2004-0095520

(51) Int. Cl.
*G10L 21/02* (2006.01)

(52) U.S. Cl. ..... 704/226; 704/227; 704/228; 704/233; 704/225; 381/312; 381/106; 381/94.3

(58) Field of Classification Search ..... 704/226, 704/227, 228, 233, 225, 270; 381/312, 106, 381/94.3, 221

See application file for complete search history.

(56) References Cited

U.S. PATENT DOCUMENTS 5,550,924 A * 8/1996 Helf et al. ..... 381/94.3
5,884,255 A 3/1999 Cox et al.
6,266,633 B1 * 7/2001 Higgins et al. ..... 704/224
6,327,564 B1 * 12/2001 Gelin et al. ..... 704/233
6,453,289 B1 * 9/2002 Ertem et al. ..... 704/225
6,615,170 B1 9/2003 Liu et al.
7,146,314 B2 * 12/2006 Wang ..... 704/233
7,236,929 B2 * 6/2007 Hodges ..... 704/233
7,346,175 B2 * 3/2008 Hui et al. ..... 381/74
2001/0000190 A1 4/2001 Oshikiri et al.
2002/0152066 A1 10/2002 Piket et al.
2002/0169602 A1 * 11/2002 Hodges ..... 704/211

FOREIGN PATENT DOCUMENTS

EP 0784311 A 7/1997
JP 2000310993 11/2000

OTHER PUBLICATIONS

Woo et al., "Robust voice activity deterction algorithm for estimating noise spectrum", Electronics Letters, vol. 36, No. 2 p. 180-181, Jan. 20, 2000.

* cited by examiner

*Primary Examiner*—Vijay B Chawan
(74) *Attorney, Agent, or Firm*—Lee, Hong, Degerman, Kang & Waimey

(57) ABSTRACT

A method and apparatus for detecting speech segments of a speech signal processing device is provided. A critical band is divided into a certain number of regions according to noise frequency characteristics, a signal threshold and a noise threshold are set for each of the regions, and it is determined whether each frame is a speech segment or noise segment by comparing the log energy calculated for each region to the corresponding signal threshold and noise threshold. Therefore, a speech segment can be detected rapidly and accurately by using a small number of operations even in a noise environment.

48 Claims, 3 Drawing Sheets

METHOD AND APPARATUS FOR DETECTING SPEECH SEGMENTS IN SPEECH SIGNAL PROCESSING

CROSS-REFERENCE TO RELATED APPLICATIONS

Pursuant to 35 U.S.C. § 119(a), this application claims the benefit of earlier filing date and right of priority to Korean Application No. 95520/2004, filed on Nov. 20, 2004, the contents of which is hereby incorporated by reference herein in its entirety

BACKGROUND OF THE INVENTION

1. Field of the Invention

The present invention relates to a speech signal processing, and more particularly, to a method and apparatus for detecting speech segments.

2. Description of the Related Art

It is very important to accurately detect speech segments of speech signals in technical fields related to speech signal processing, such as speech analysis and synthesis, speech recognition, speech coding and speech encoding. However, a typical related art detector for detecting speech segments has a complicated configuration, requires large amounts of calculation and cannot perform real time processing.

Typical related art speech segment detection methods include, for example, an energy and zero crossing rate detection method, a method for determining the presence of a speech signal by obtaining a cepstral coefficient of a segment identified by name and a cepstral distance of a current segment, and a method for determining the presence of a speech signal by measuring coherence between two voice signals and noise. Such speech segment detection methods are problematic in that their performance with regard to detecting speech segments are not outstanding in actual applications, the device configuration is complicated, it is difficult to apply the methods if a SNR (signal to noise ratio) is low, and it is difficult to detect speech segments if background noise detected through a peripheral environment abruptly changes.

Consequently, in technical fields for which speech signal processing is applied, such as a communication system, a mobile communication system and a speech recognition system, there is a need for a speech segment detection method for which the performance with regard to voice segment detection is outstanding even under circumstances where background noise abruptly changes, the amount of calculation required for speech segment detection is small, and real time processing is facilitated. The present invention addresses these and other needs.

SUMMARY OF THE INVENTION

Features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

Therefore, an object of the present invention is to provide a method and apparatus for detecting speech segments in a speech signal processing device which can detect a speech segment accurately even in a noisy environment, requires a small amount of calculations for speech segment detection, and is capable of real time processing.

In one aspect of the present invention, an apparatus for detecting speech segments of a speech signal is provided. The apparatus includes an input unit adapted to receive the speech signal, a critical band dividing unit adapted to divide a critical band of the received speech signal into a plurality of regions according to noise frequency characteristics, a signal threshold calculation unit adapted to calculate a signal threshold for each of the plurality of regions, a noise threshold calculation unit adapted to calculate a noise threshold for each of the plurality of regions, a segment discriminating unit adapted to determine whether a current frame of the speech signal is a noise segment or a speech segment according to a log energy of each of the plurality of regions and a signal processing unit adapted to control the input unit, critical band dividing unit, signal threshold calculation unit, noise threshold calculation unit and segment discriminating unit for detection of speech segments.

It is contemplated that the apparatus may also include a user interface unit adapted to input a control signal for initiating the detection of speech segments, an output unit adapted to output detected speech segments and a memory unit adapted to store a program and data required for the speech segment detection. It is further contemplated that the critical band dividing unit is further adapted to divide the critical band into a plurality of regions corresponding to a type of noise environment. Preferably, the critical band dividing unit divides the critical band into two regions if the noise frequency characteristics correspond to a car environment and divides the critical band into three or four regions if the noise frequency characteristics correspond to peripheral noise generated when a user is walking.

Preferably, the signal processing unit is further adapted to set the plurality of regions into which the critical band dividing unit divides the critical band of the received speech signal according to a type of noise environment selected by a user. It is contemplated that the signal processing unit is further adapted to control operations of calculating an initial average value and calculating an initial standard deviation of the log energy of each of the plurality of regions for a certain number of frames input at an initial stage.

It is contemplated that the number of frames input at an initial stage is four or five. Preferably, if the current frame is determined as a speech segment, the signal threshold calculation unit calculates the average value and standard deviation of the speech log energy for each of the plurality of regions of the frame and updates a signal threshold by using the calculated average value and standard deviation.

Preferably, the signal threshold is calculated for each of the plurality of regions according to the mathematical expression $Tsk=\mu_{sk}+\alpha_{sk}*\delta_{sk}$, where $\mu_{sk}$ is an average value of the speech log energy of the k-th region of the current frame, $\delta_{sk}$ is a standard deviation value of the speech log energy of the k-th region of the current frame, $\alpha_{sk}$ is a hysteresis value of the k-th region of the current frame, $T_{sk}$ is a signal threshold of the k-th region of the current frame, and the maximum value of k is the number of regions into which the critical band of the received speech signal is divided.

Preferably, the average value and standard deviation are calculated by the mathematical expression $\mu_{sk}(t)=\gamma*\mu_{sk}(t-1)+(1-\gamma)*E_k$, $[E_k^2]_{mean}(t)=\gamma*[E_k^2]_{mean}(t-1)+(1-\gamma)*E_k^2$, $\delta_{sk}(t)=\mathrm{root}([E_k^2]_{mean}(t)-[\mu_{sk}(t)]^2)$, where $\mu_{sk}(t-1)$ is an average value of the speech log energy of the k-th region of the preceding frame, $E_k$ is a speech log energy of the k-th region of the current frame, $\delta_{sk}(t)$ is a standard deviation value of the speech log energy of the k-th region of the current frame, $\gamma$ is a weighted value, and the maximum value of k is the number of regions into which the critical band of the received speech signal is divided.

It is contemplated that, if the current frame is determined as a noise segment, the noise threshold calculation unit calculates an average value and a standard deviation of the noise log energy for each of the plurality of regions of the frame and updates a noise threshold by using the calculated average value and standard deviation. Preferably, the noise threshold is calculated for each of the plurality of regions according to the mathematic expression $T_{nk}=\mu_{nk}+\beta_{nk}*\delta_{nk}$, where $\mu_{nk}$ is an average value of the noise log energy of the k-th region of the current frame, $\delta_{nk}$ is a standard deviation value of the noise log energy of the k-th region of the current frame, $\beta_{nk}$ is a hysteresis value of the k-th region of the current frame, $T_{nk}$ is a noise threshold of the k-th region of the current frame, and the maximum value of k is the number of regions into which the critical band of the received speech signal is divided.

Preferably, the average value and standard deviation are calculated by the mathematical expression $\mu_{nk}(t)=\gamma*\mu_{nk}(t-1)+(1-\gamma)*E_k$, $[E_k^2]_{mean}(t)=\gamma*[E_k^2]_{mean}(t-1)+(1-\gamma)*E_k^2$, $\delta_{nk}(t)=\mathrm{root}([E_k^2]_{mean}(t)-[\mu_{nk}(t)]^2)$, where $\mu_{nk}(t-1)$ is an average value of the noise log energy of the k-th region of the preceding frame, $E_k$ is a noise log energy of the k-th region of the current frame, $\delta_{nk}(t)$ is a standard deviation value of the noise log energy of the k-th region of the current frame, $\gamma$ is a weighted value, and the maximum value of k is the number of regions into which the critical band of the received speech signal is divided.

It is contemplated that the segment discriminating unit is further adapted to calculate the log energy for each of the plurality of regions. Preferably, the segment discriminating unit determines that the current frame is a speech segment if at least one of the plurality of regions has a log energy that is greater than a signal threshold and determines that the current frame is a noise segment if none of the plurality of regions has a log energy that is greater than a signal threshold and at least one of the plurality of regions has a log energy that is smaller than a noise threshold.

It is contemplated that the segment discriminating unit is further adapted to apply determined segments of the preceding frame to the current frame if none of the plurality of regions has a log energy that is greater than a signal threshold or smaller than a noise threshold. Preferably, the segment discriminating unit determines whether a current frame of the speech signal is a noise segment or a speech segment according to the expression IF ($E_1>T_{s1}$ OR $E_2>T_{s2}$ OR $E_k>T_{sk}$), the frame is determined as a speech segment, ELSE IF ($E_1<T_{n1}$ OR $E_2<T_{n2}$ OR $E_k<T_{nk}$), the frame is determined as a noise segment, ELSE, the frame is determined as a noise segment or a speech segment according to the determination of a corresponding segment of a preceding frame, where E is a log energy for each of the plurality of regions, $T_s$ is a signal threshold for each of the plurality of regions, $T_n$ is a noise threshold for each of the plurality of regions, and k is the number of regions into which the critical band of the received speech signal is divided.

In another aspect of the present invention, an apparatus for detecting speech segments of a speech signal, is provided. The apparatus includes a user interface unit adapted to receive a user control command to initiate speech segment detection, an input unit adapted to receive an input signal according to the user control command and a processor adapted to format the input signal into a plurality of frames of a critical band, divide the critical band of each of the plurality of frames into a predetermined number of regions according to noise frequency characteristics, calculate a signal threshold and a noise threshold for each of the predetermined number of regions, compare a log energy of each of the predetermined number of regions to the corresponding signal threshold and noise threshold, and determine whether each of the plurality of frames is a speech segment or a noise segment according to the comparison.

It is contemplated that the processor is further adapted to set the predetermined number of regions according to a type of a noise environment selected by the user. Preferably, the processor is further adapted to calculate an initial average value and an initial standard deviation of the log energy for each of the predetermined number of regions for a predetermined number of frames input at an initial stage and calculate the initial signal threshold and the initial noise threshold using the initial average value and the initial standard deviation.

It is contemplated that the processor determines whether the current frame is a speech segment or noise segment according to the expression IF ($E_1>T_{s1}$ OR $E_2>T_{s2}$ OR $E_k>T_{sk}$), the frame is determined as a speech segment, ELSE IF ($E_1<T_{n1}$ OR $E_2<T_{n2}$ OR $E_k<T_{nk}$), the frame is determined as a noise segment, ELSE, the frame is determined as a noise segment or a speech segment according to the determination of a corresponding segment of a preceding frame, where E is a log energy for each of the predetermined number of regions, $T_s$ is a signal threshold for each of the predetermined number of regions, $T_n$ is a noise threshold for each of the predetermined number of regions, and k is the predetermined number of regions.

It is contemplated that, if the current frame is determined as a noise segment, the processor calculates an average value and a standard deviation of the speech log energy for each of the predetermined number of regions of the frame and updates the signal threshold by using the calculated average value and standard deviation. Preferably, when the frame is determined to be a noise segment, the processor calculates an average value and a standard deviation of the noise log energy for each of the predetermined number of regions of the frame and updates the noise threshold by using the calculated average value and standard deviation.

In another aspect of the present invention, a method for detecting speech segments of a speech signal is provided. The method includes dividing a critical band of an input signal into a predetermined number of regions according to noise frequency characteristics, comparing a log energy calculated for each of the predetermined number of regions to a threshold set for each of the predetermined number of regions and determining whether the input signal is a speech segment or a noise segment according to the comparison.

It is contemplated that the method further includes updating the threshold for each of the predetermined number of regions according to the result of the determination by using an average value and a standard deviation of the log energy calculated for each of the predetermined number of regions. Preferably, the threshold for each of the predetermined number of regions comprises a signal threshold and a noise threshold.

It is contemplated that the method further includes updating the signal threshold for each of the predetermined number of regions by using the average value and standard deviation of the log energy calculated for each of the predetermined number of regions when the input signal is determined as a speech segment. It is further contemplated that the method further includes updating the noise threshold for each of the predetermined number of regions by using the average value and standard deviation of the log energy calculated for each of the predetermined number of regions when the input signal is determined as a noise segment.

Preferably, the method further includes calculating an initial average value and an initial standard deviation of the log energy for each of the predetermined number of regions for a predetermined number of frames input at an initial stage and setting an initial threshold for each of the predetermined number of regions by using the initial average value and the initial standard deviation.

In another aspect of the present invention, a method for detecting speech segments of a speech signal is provided. The method includes formatting the speech signal into a plurality of frames according to a critical band, dividing a current frame of the speech signal into a predetermined number of regions according to noise frequency characteristics, determining whether the current frame is a speech segment or a noise segment according to a log energy calculated for each of the predetermined number of regions and updating a signal threshold and a noise threshold for each of the predetermined number of regions by using the log energy for each of the predetermined number of regions.

Preferably, the method determines whether the current frame is a speech segment or a noise segment by comparing the log energy calculated for each of the predetermined number of regions to the signal threshold and the noise threshold for each of the predetermined number of regions. It is contemplated that the current frame is determined as a speech segment if at least one of the predetermined number of regions has a log energy that is greater than the signal threshold. It is further contemplated that the current frame is determined as a noise segment if none of the predetermined number of regions has a log energy that is greater than the signal threshold and at least one of the predetermined number of regions has a log energy that is smaller than the noise threshold. Moreover, it is contemplated that determined segments of a preceding frame are applied to the current frame if none of the predetermined number of regions has a log energy that is greater than the signal threshold or smaller than the noise threshold.

Preferably, the method further includes setting an initial signal threshold and initial noise threshold for each of the predetermined number of regions by using an initial average value and an initial standard deviation of the log energy calculated for each of the predetermined number of regions for a predetermined number of frames input at an initial stage. It is contemplated that the predetermined number of frames is three or four. It is further contemplated that the predetermined number of regions is two if the noise frequency characteristics correspond to car noise and the predetermined number of regions is three or four if the noise frequency characteristics correspond to peripheral noise generated when a user is walking. Moreover, it is contemplated that the predetermined number of regions is set according to a type of a noise environment selected by a user.

Preferably, the method determines whether the current frame is a speech segment or a noise segment comprises according to the expression IF ($E_1>T_{s1}$ OR $E_2>T_{s2}$ OR $E_k>T_{sk}$),), the frame is determined as speech segment, ELSE IF ($E_1<T_{n1}$ OR $E_2<T_{n2}$ OR $E_k<T_{nk}$), the frame is determined as noise segment, ELSE, the frame is determined as a noise segment or a speech segment according to the determination of a corresponding segment of a preceding frame, where E is a log energy for each of the predetermined number of regions, $T_s$ is a signal threshold for each of the predetermined number of regions, $T_n$ is a noise threshold for each of the predetermined number of regions, and k is the predetermined number of regions. It is contemplated that the method further includes calculating an average value and a standard deviation of the speech log energy for each of the predetermined number of regions and updating a signal threshold for each of the predetermined number of regions when the frame is determined to be a speech segment.

Preferably, the method further includes updating the signal threshold for each of the predetermined number of regions according to the mathematic expression $T_{sk}=\mu_{sk}+\alpha_{sk}*\delta_{sk}$, where μ is an average value of the speech log energy of the k-th predetermined region, δ is a standard deviation value of the speech log energy of the k-th predetermined region, α is a hysteresis value, $T_{sk}$ is a signal threshold, and the maximum value of k is the predetermined number of regions.

Preferably, the method further includes calculating the average value and standard deviation of each of the predetermined number of regions according to the mathematical expression $\mu_{sk}(t)=\gamma*\mu_{sk}(t-1)+(1-\gamma)*E_k$, $[E_k^2]_{mean}(t)=\gamma*[E_k^2]_{mean}(t-1)+(1-\gamma)*E_k^2$, $\delta_{sk}(t)=\mathrm{root}([E_k^2]_{mean}(t)-[\mu_{sk}(t)]^2)$, where $\mu_{sk}(t-1)$ is an average value of the speech log energy of the k-th predetermined region of a preceding frame, $E_k$ is a speech log energy of the k-th predetermined region of the current frame, $\delta_{sk}(t)$ is a standard deviation value of the speech log energy of the k-th predetermined region of the current frame, γ is a weighted value, and the maximum value of k is the predetermined number of regions.

It is contemplated that the method further includes calculating an average value and a standard deviation of the noise log energy for each of the predetermined number of regions and updating a noise threshold for each of the predetermined number of regions by using the calculated average value when the current frame is determined as a noise segment.

Preferably, the method further includes calculating the noise threshold for each of the predetermined number of regions according to the mathematic expression $T_{nk}=\mu_{nk}+\beta_{nk}*\delta_{nk}$, where μ is an average value of the noise log energy of the k-th predetermined region, δ is a standard deviation value of the noise log energy of the k-th predetermined region, $\beta_{nk}$ is a hysteresis value of the k-th predetermined region, $T_{nk}$ is a noise threshold, and the maximum value of k is the predetermined number of regions.

Preferably, the method further includes calculating the average value and standard deviation of each of the predetermined number of regions according to the mathematical expression $\mu_{nk}(t)=\gamma*\mu_{nk}(t-1)+(1-\gamma)*E_k$, $[E_k^2]_{mean}(t)=\gamma*[E_k^2]_{mean}(t-1)+(1-\gamma)*E_k^2$, $\delta_{nk}(t)=\mathrm{root}([E_k^2]_{mean}(t)-[\mu_{nk}(t)]^2)$, where $\mu_{nk}(t-1)$ is an average value of the noise log energy of the k-th predetermined region of a preceding frame, $E_k$ is a noise log energy of the k-th predetermined region of the current frame, $\delta_{nk}(t)$ is a standard deviation value of the noise log energy of the k-th predetermined region of the current frame, γ is a weighted value, and the maximum value of k is the predetermined number of regions.

Additional features and advantages of the invention will be set forth in the description which follows, and in part will be apparent from the description, or may be learned by practice of the invention. It is to be understood that both the foregoing general description and the following detailed description of the present invention are exemplary and explanatory and are intended to provide further explanation of the invention as claimed.

These and other embodiments will also become readily apparent to those skilled in the art from the following detailed description of the embodiments having reference to the attached figures, the invention not being limited to any particular embodiments disclosed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. Features, elements, and aspects of the invention that are referenced by the same numerals in different figures represent the same, equivalent, or similar features, elements, or aspects in accordance with one or more embodiments.

DETAILED DESCRIPTION OF THE PREFERRED EMBODIMENTS

The present invention relates to a method and apparatus for detecting speech segments in a speech signal processing device which can detect a speech segment accurately even in a noisy environment, requires a small amount of calculations for speech segment detection, and is capable of real time processing. Although the present invention is illustrated with respect to a communication system, it is contemplated that the present invention may be utilized anytime it is desired to more accurately detect speech segments in a noisy environment in a manner that is more efficient and capable of real time processing.

Generally, the range of audible frequencies that humans can hear is from about 20 Hz to 20,000 Hz. This range is referred to as a critical band. The critical band can be extended or reduced according to circumstances, such as proficiency and physical disabilities. The critical band is a frequency band taking human auditory characteristics into account.

Figure 1:
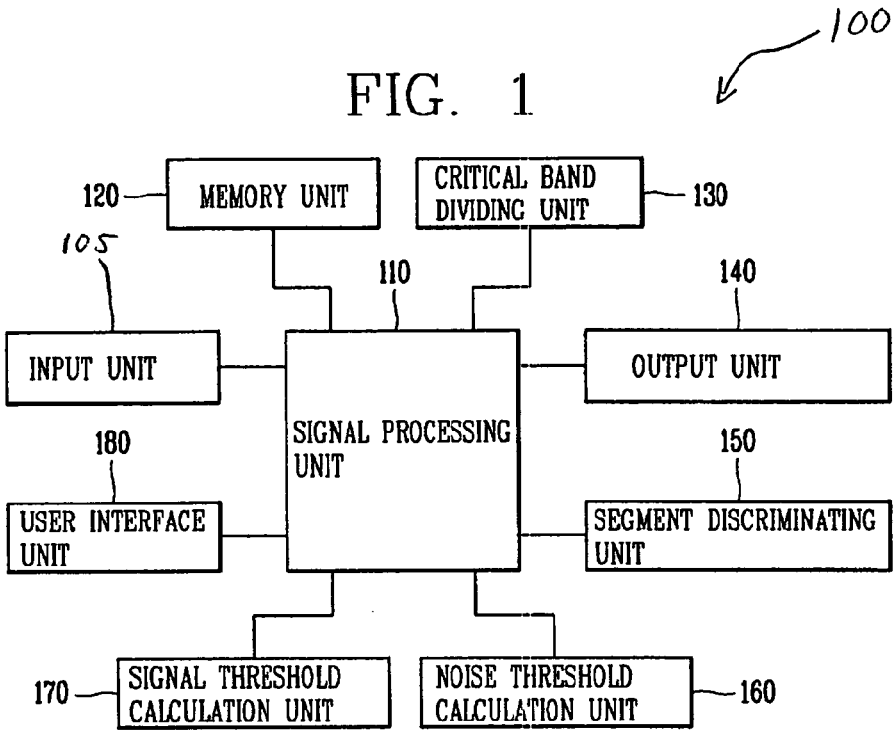
FIG. 1 is a view illustrating one method for detecting speech segments of a speech signal processing device according to the present invention.

In the present invention, in order to use human auditory characteristics, a critical band is divided into a certain number of regions by taking the noise frequency characteristics of various environments into account. A signal threshold and a noise threshold are calculated for each region and it is determined whether each frame is a speech segment or noise segment by comparing the log energy of each region to a signal threshold and noise threshold for each region. FIG. 1 is a view illustrating an apparatus 100 for detecting speech segments according to the present invention.

The apparatus 100 includes an input unit 105 for inputting a speech signal; a signal processing unit 110 for controlling the overall operation of the apparatus for speech segment detection; a critical band dividing unit 130 for dividing a critical band of the input signal into a certain number of regions according to noise frequency characteristics; a signal threshold calculation unit 170 for calculating a signal threshold for each region; a noise threshold calculation unit 160 for calculating a noise threshold for each region; and a segment discriminating unit 150 for determining whether a current frame is a noise segment or speech segment according to the log energy of each region. The speech signal may include noise components.

The apparatus 100 further includes: a user interface unit 180 for inputting a control signal to initiate the detection of speech segments; an output unit 140 for outputting detected speech segments; and a memory unit 120 for storing a program and data required for speech segment detection. The user interface 180 can include a keyboard or other types of input means.

The operation of the apparatus 100 will be described below. A speech signal processing device may include various kinds of devices having a speech segment detection function, such as a mobile terminal having a speech recognition function or a speech recognition device.

In the present invention, the critical band is divided into a certain number of regions according to various types of noise frequency characteristics, a log energy is calculated for each region and compared to a signal threshold and noise threshold set for each region. A speech segment is detected according to the result of the comparison.

For example, if the user is in a car environment, a critical band is divided into two regions on a 1-2 KHz boundary since noise is mostly distributed at a low frequency band. If the user is walking, the critical band is divided into three or four regions. In this way, the number of regions into which the critical band is divided may vary according to the noise frequency characteristics of the environment. Consequently, the present invention can further improve the performance of speech segment detection according to the frequency characteristics of background noise.

Figure 2:
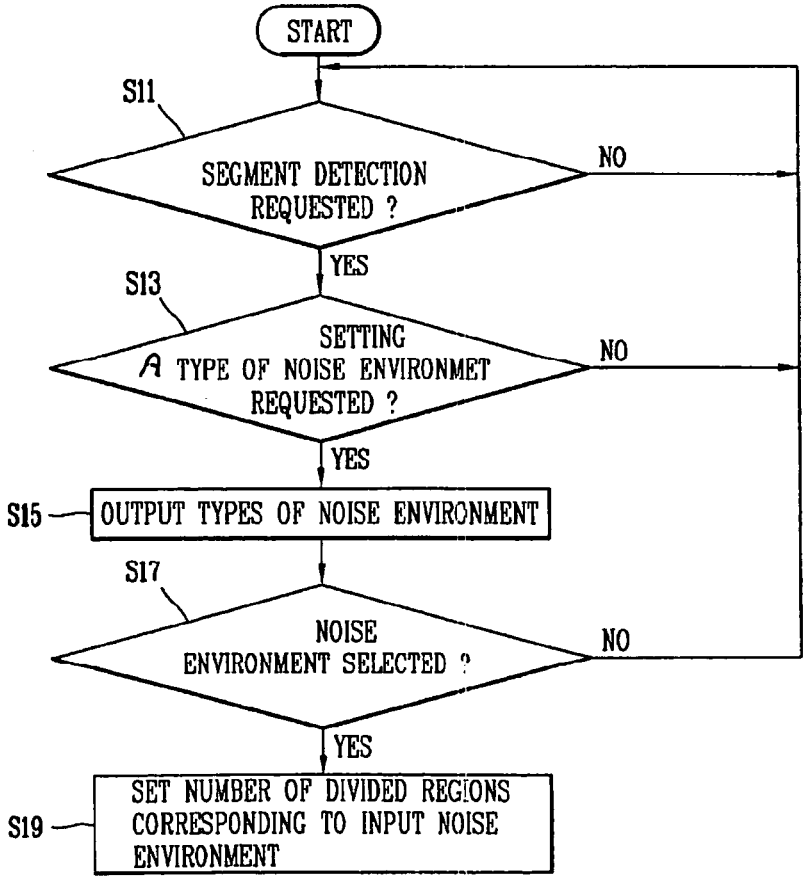
FIG. 2 is a view illustrating a method for determining a number of regions into which a critical band is divided according to noise frequency characteristics according to the present invention.

FIG. 2 illustrates a method according to the present invention for determining a number of regions into which a critical band is divided according to the noise frequency characteristics. If it is desired to detect speech segments (S11), the speech signal processing device checks if a user has requested to select the type of a noise environment in order to set the number of divided regions according to the noise frequency characteristics. If the user requested to select the type of a noise environment (S13), the speech signal processing device outputs the types of noise environment from which the user may select (S15).

The type of noise environment may include a car environment, a walking environment, or a similar environment. For example, when the user is in a car, the user can select the car environment option from among various options provided by the speech signal processing device.

When the user selects the noise environment (S17), the speech signal processing device sets the number of regions corresponding to the selected noise environment (S19). Once the number of divided regions is set, the speech signal processing device can divide the critical band according to the set number of divided regions for speech segment detection.

Figure 3:
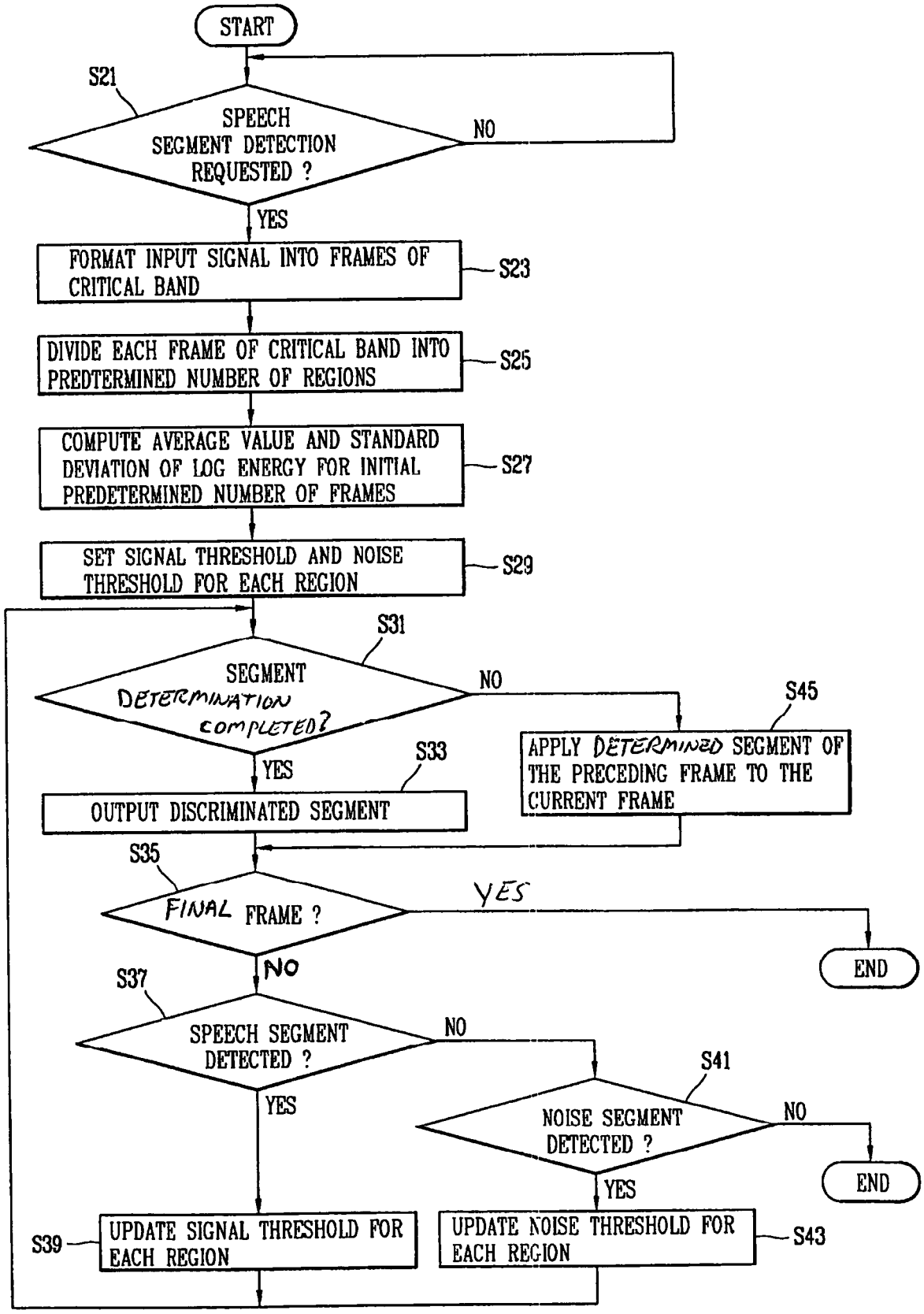
FIG. 3 is a view illustrating a method for detecting speech segments of a speech signal processing device according to the present invention.
Figure 4:
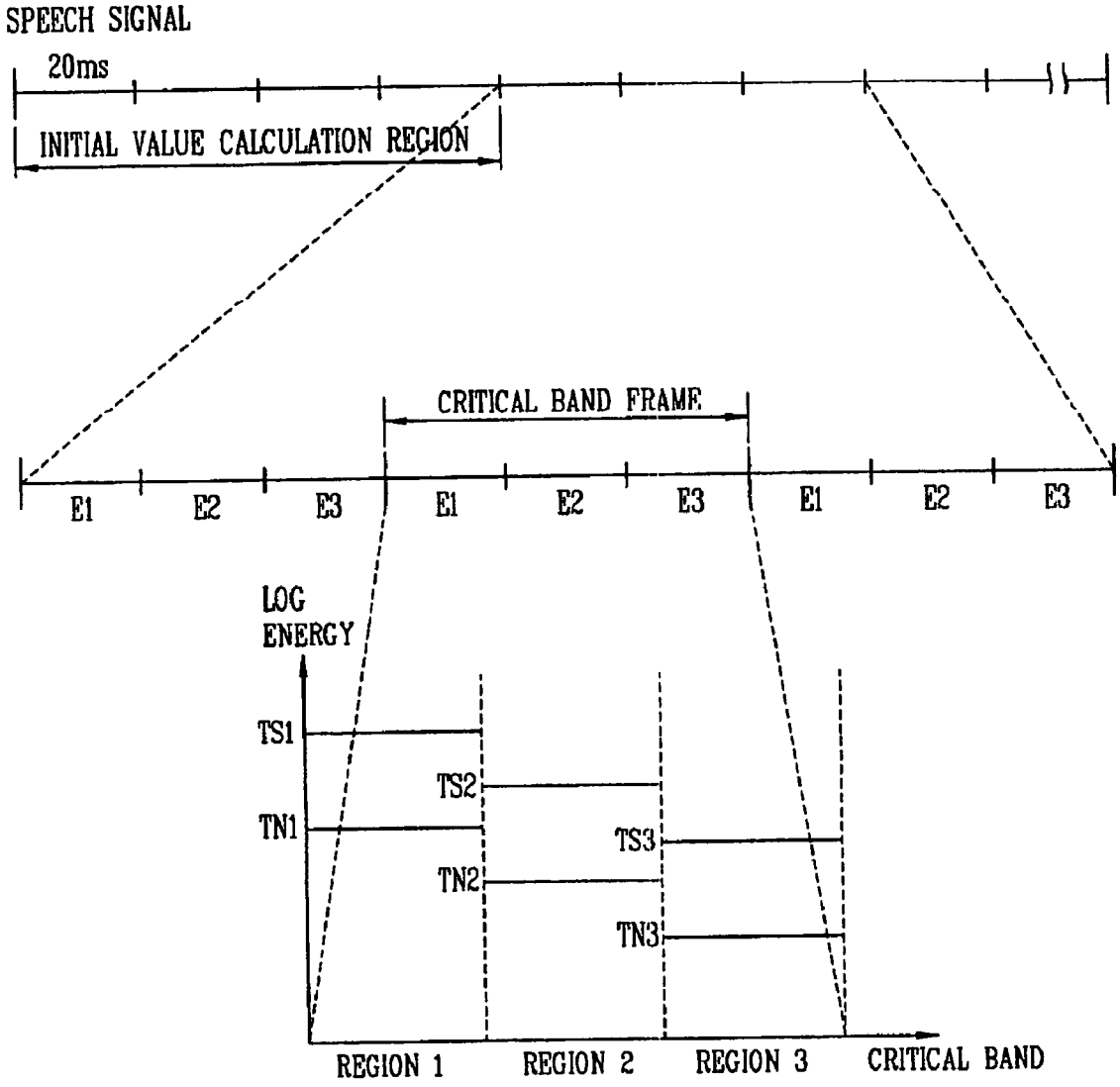
FIG. 4 is a view illustrating the structure of a frame for speech segment detection according to the present invention.

FIG. 3 illustrates a method for detecting speech segments of a speech signal according to the present invention. FIG. 4 illustrates the structure of a frame for speech segment detection according to the present invention.

When a power source is applied to the speech signal processing device, the speech signal processing device enters a ready state by loading an operation program, an application program and data from a memory unit 120.

If the detection of speech segments is requested (S21), a critical band dividing unit 130 of the speech signal processing device formats an input signal into frames as illustrated in FIG. 4 (S23). Each frame has a frequency signal of the critical band.

The critical band dividing unit 130 subdivides each frame into a predetermined number of regions (S25). Each frame, that is, the critical band, can be divided according to the number of divided regions set in FIG. 2.

The present invention will be described with respect to one frame divided into three regions. However, it can be easily understood that the present invention is applicable where each frame is divided into any number of regions.

First, the signal threshold calculation unit 170 and noise threshold calculation unit 160 of the speech signal processing device evaluate a silent segment containing no speech signals during a first certain number of frames of an input signal and calculate the initial average value and initial standard deviation of the log energy for each region of the first certain number of frames (S27). The signal threshold calculation unit 170 calculates the initial speech threshold of each region of a frame input after the silent segment by using the initial average value and initial standard deviation of the log energy for each region calculated for the certain number of frames as illustrated in Mathematical Expression 1. The noise threshold calculation unit 160 calculates the initial noise threshold of each region of the frame input after the silent segment by using the initial average value and initial standard deviation of the log energy for each region calculated for the predetermined number of frames as illustrated in Mathematical Expression 2 (S29).

(Mathematical Expression 1)

$$T_{s1}=\mu_{n1}+\alpha_{s1}*\delta_{n1}$$

$$T_{s2}=\mu_{n2}+\alpha_{s2}*\delta_{n2}$$

$$T_{sk}=\mu_{nk}+\alpha_{sk}*\delta_{nk}$$

where μ is an average value, δ is a standard deviation value, α is a hysteresis value, and k is a number of divided regions of a frame.

(Mathematical Expression 2)

$$T_{n1}=\mu_{n1}+\beta_{n1}*\delta_{n1}$$

$$T_{n2}=\mu_{n2}+\beta_{n2}*\delta_{n2}$$

$$T_{nk}=\mu_{nk}+\beta_{nk}*\delta_{nk}$$

where μ is an average value, δ is a standard deviation value, β is a hysteresis value, and k is a number of divided regions of a frame.

The hysteresis values α and β are determined by experimentation and stored in the memory unit 120. In the illustrated example, k is 3.

After a mobile terminal or similar device is powered on, there is a normally a duration of silence lasting at least 100 ms before speech is input. If a frame used in speech signal processing is 20 ms, a frame of 100 ms is divided into four or five frame segments.

Therefore, a first certain number of frames, such as 4 or 5, may be utilized for calculating an initial average value and an initial standard deviation. For example, if the number of frames considered as silent segments is 4, the critical band dividing unit 130 subdivides each frame input after four frames, or the first to fourth frames, into three regions.

Thereafter, the segment discriminating unit 150 calculates a log energy for each region of each frame. For a frame input for the fifth time, or the fifth frame, the segment discriminating unit 150 calculates a first log energy $E_1$ for the first region of the fifth frame, a second log energy $E_2$ for the second region of the fifth frame and a third log energy $E_3$ for the third region of the fifth frame. The segment discriminating unit 150 determines whether each frame is a speech segment or noise segment by using Mathematic Expression 3.

(Mathematical Expression 3)

IF ($E_1>T_{s1}$ OR $E_2>T_{s2}$ OR $E_3>T_{s3}$)
VOICE_ACTIVITY=speech segment

ELSE IF ($E_1<T_{n1}$ OR $E_2<T_{n2}$ OR $E_3<T_{n3}$)
VOICE_ACTIVITY=noise segment ELSE VOICE_ACTIVITY=VOICE_ACTIVITY before, wherein E is a log energy, $T_s$ is a signal threshold, and $T_n$ is a noise threshold.

As illustrated in Mathematical Expression 3, the segment discriminating unit 150 compares the log energy of each region of the fifth frame to the corresponding signal threshold $T_{s1}$ and noise threshold $T_{n1}$ of each region. If there is at least one area with a log energy that is greater than the signal threshold, the segment discriminating unit 150 determines the fifth frame to be a speech segment (S31). If there is no region having a log energy that is greater than the signal threshold, but there is one or more regions having a log energy that is smaller than the noise threshold, the segment discriminating unit 150 determines the fifth frame to be a noise segment and sets it as a noise segment (S31).

When the determination of whether the current frame (fifth frame) is a noise segment or speech segment is completed, the signal processing unit 110 can output the current frame through the output unit 140 (S33). If the current frame is not the final frame (S35), the signal processing unit 100 controls the signal threshold calculation unit 170 or the noise threshold calculation unit 160 so that the signal threshold or noise threshold may be updated If the current frame is determined as a speech segment (S37), the signal threshold calculation unit 170 re-calculates the average value and standard deviation of the speech log energy for each region according to Mathematical Expression 4 under control of the signal processing unit 110. The calculated average value and standard deviation of the speech log energy are adapted to Mathematical Expression 1, thereby updating the signal threshold for each region (S39). At this time, the noise threshold is not updated.

(Mathematical Expression 4)

$$\mu_{s1}(t)=\gamma*\mu_{s1}(t-1)+(1-\gamma)*E_1$$

$$[E_1^2]\text{mean}(t)=\gamma*[E_1^2]\text{mean}(t-1)+(1-\gamma)*E_1^2$$

$$\delta_{s1}(t)=\text{root}([E_1^2]\text{mean}(t)-[\mu_{s1}(t)]^2)$$

$$\mu_{s2}(t)=\gamma*\mu_{s2}(t-1)+(1-\gamma)*E^2$$

$$[E_2^2]\text{mean}(t)=\gamma*[E_2^2]\text{mean}(t-1)+(1-\gamma)*E_2^2$$

$$\delta_{s2}(t)=\text{root}([E_2^2]\text{mean}(t)-[\mu_{s2}(t)]^2)$$

$$\mu_{s3}(t)=\gamma*\mu_{s3}(t-1)+(1-\gamma)*E^3$$

$$[E_3^2]\text{mean}(t)=\gamma*[E_3^2]\text{mean}(t-1)+(1-\gamma)*E_3^2$$

$$\delta_{s3}(t)=\text{root}([E_3^2]\text{mean}(t)-[\mu_{s3}(t)]^2)$$

wherein μ is an average value of a speech log energy, δ is a standard deviation value, t is a frame time value, γ is a weight value as an experimental value, and $E_1$, $E_2$ and $E_3$ are speech log energy values in a corresponding region.

If the current frame is determined as a noise segment (S41), the noise threshold calculation unit 160 re-calculates the average value and standard deviation of the noise log energy for each region according to Mathematical Expression 5 under control of the signal processing unit 110. The calculated average value and standard deviation of the noise log energy are adapted to Mathematical Expression 2, thereby updating the noise threshold for each region (S43).

(Mathematical Expression 5)

$$\mu_{n1}(t)=\gamma*\mu_{n1}(t-1)+(1-\gamma)*E_1$$

$$[E_1^2]\text{mean}(t)=\gamma*[E_1^2]\text{mean}(t-1)+(1-\gamma)*E_1^2$$

$$\delta_{n1}(t)=\text{root}([E_1^2]\text{mean}(t)-[\mu_{n1}(t)]^2)$$

$$\mu_{n2}(t)=\gamma*\mu_{n2}(t-1)+(1-\gamma)*E_2$$

$$[E_2^2]\text{mean}(t)=\gamma*[E_2^2]\text{mean}(t-1)+(1-\gamma)*E_2^2$$

$$\delta_{n2}(t)=\text{root}([E_2^2]\text{mean}(t)-[\mu_{n2}(t)]^2)$$

$$\mu_{n3}(t)=\gamma*\mu_{n3}(t-1)+(1-\gamma)*E_3$$

$$[E_3^2]\text{mean}(t)=\gamma*[E_3^2]\text{mean}(t-1)+(1-\gamma)*E_3^2$$

$$\delta_{n3}(t)=\text{root}([E_3^2]\text{mean}(t)-[\mu_{n3}(t)]^2)$$

wherein $\mu$ is an average value of a noise log energy, $\delta$ is a standard deviation value, t is a frame time value, $\gamma$ is a weight value as an experimental value, and $E_1$, $E_2$ and $E_3$ are noise log energy values in a corresponding region.

In Mathematical Expression 4 and Mathematical Expression 5, $\gamma$ may have, for example, a value of 0.95, and is stored in the memory unit 120. In Mathematical Expression 4 and Mathematical Expression 5, the average value of a log energy of each region is calculated by a recursion method so that a corresponding threshold adapted to an input signal can be calculated and the calculation of the average value by the recursion method facilitates real time processing of the speech segment processor.

However, if, as the result of comparison in step S31 between the log energy of each region of the corresponding frame and the signal threshold $T_{s1}$ and noise threshold $T_{n1}$ of each region, there is no region having a log energy that is greater than the signal threshold and no region having a log energy that is smaller than the noise threshold, the segment discriminating unit 150 applies determined segments of the preceding frame to the corresponding frame (S45). In this way, if the preceding frame was a speech segment, the segment discriminating unit 150 determines the corresponding current frame as a speech segment, and, if the preceding frame was a noise segment, the corresponding current frame is determined as a noise segment. Once the type of segments of the corresponding current frame are determined, the signal processing unit 110 proceeds to step S35.

As disclosed herein, the present invention can accurately detect speech segments by using rapid real-time processing for the detection of speech segments from an input signal input in a noise environment by using only a small amount of calculations (operations).

Another embodiment of an apparatus for detecting speech segments according to the present invention will now be described. The apparatus may include: a user interface unit for receiving a user control command for initiating speech segment detection; an input unit for receiving an input signal according to the user control command; and a processor for formatting the input signal by frames of a critical band, dividing the critical band of each frame into a predetermined number of regions according to noise frequency characteristics, calculating a signal threshold and a noise threshold for each region, comparing the log energy of each region to the signal threshold and noise threshold of each region, and determining whether a speech segment of each frame is a speech segment or noise segment according to the comparison. The apparatus may further include: an output unit for outputting detected speech segments and a memory unit for storing a program and data required for the speech segment detection operation. The operation of the apparatus for detecting speech segments may be performed in the same, an equivalent or a similar manner as the operation explained with reference to FIGS. 2 and 3.

The present invention can detect speech segments from an input signal input in a noise environment in real time by using only a small number of operations. The present invention can detect speech segments accurately even in a noise environment since it subdivides a critical band into a predetermined number of regions according to noise frequency characteristics and detects speech segments for each region. The present invention can detect speech segments more accurately according to the noise frequency characteristics by differentiating a number of divided regions of a critical band according to a noise environment.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An apparatus for detecting speech segments of a speech signal, the apparatus comprising:

an input unit adapted to receive the speech signal;

a critical band dividing unit adapted to divide a critical band of the received speech signal into a plurality of regions according to noise frequency characteristics;

a signal threshold calculation unit adapted to calculate a signal threshold for each of the plurality of regions based on a speech log energy;

a noise threshold calculation unit adapted to calculate a noise threshold for each of the plurality of regions based on a noise log energy;

a segment discriminating unit adapted to determine whether a current frame of the speech signal is a noise segment or a speech segment by comparing a log energy of each of the plurality of regions with the signal threshold and the noise threshold; and a signal processing unit adapted to control the input unit, critical band dividing unit, signal threshold calculation unit, noise threshold calculation unit and segment discriminating unit for detection of speech segments.

2. The apparatus of claim 1, further comprising:

a user interface unit adapted to input a control signal for initiating the detection of speech segments;

an output unit adapted to output detected speech segments; and a memory unit adapted to store a program and data required for the speech segment detection.

3. The apparatus of claim 1, wherein the critical band dividing unit is further adapted to divide the critical band into a plurality of regions corresponding to a type of noise environment.

4. The apparatus of claim 3, wherein the critical band dividing unit divides the critical band into two regions if the noise frequency characteristics correspond to a car environment.

5. The apparatus of claim 3, wherein the critical band dividing unit divides the critical band into three or four regions if the noise frequency characteristics correspond to peripheral noise generated when a user is walking.

6. The apparatus of claim 3, wherein the signal processing unit is further adapted to set the plurality of regions into which the critical band dividing unit divides the critical band of the received speech signal according to a type of noise environment selected by a user.

7. The apparatus of claim 1, wherein the signal processing unit is further adapted to control operations of calculating an initial average value and calculating an initial standard deviation of the log energy of each of the plurality of regions for a certain number of frames input at an initial stage.

8. The apparatus of claim 7, wherein the number of frames input at an initial stage is four or five.

9. The apparatus of claim 1, wherein if the current frame is determined as a speech segment, the signal threshold calculation unit is further adapted to calculate an average value and a standard deviation of the speech log energy for each of the plurality of regions and to update a signal threshold by using the calculated average value and standard deviation.

10. The apparatus of claim 9, wherein the signal threshold calculation unit is further adapted to calculate the signal threshold for each of the plurality of regions according to the mathematical expression $T_{sk}=\mu_{sk}+\alpha_{sk}*\delta_{sk}$, wherein $\mu_{sk}$ is an average value of the speech log energy of the k-th region of the current frame, $\delta_{sk}$ is a standard deviation value of the speech log energy of the k-th region of the current frame, $\alpha_{sk}$ is a hysteresis value of the k-th region of the current frame, $T_{sk}$ is a signal threshold of the k-th region of the current frame, and the maximum value of k is the number of regions into which the critical band of the received speech signal is divided.

11. The apparatus of claim 9, wherein signal threshold calculation unit is further adapted to calculate the average value and standard deviation according to the mathematical expression:

$$\mu_{sk}(t)=\gamma*\mu_{sk}(t-1)+(1-\gamma)*E_k$$

$$[E_k^2]_{mean}(t)=\gamma*[E_k^2]_{mean}(t-1)+(1-\gamma)*E_k^2$$

$$\delta_{sk}(t)=\mathrm{root}([E_k^2]_{mean}(t)-[\mu_{sk}(t)]^2),$$

wherein $\mu_{sk}$ (t−1) is an average value of the speech log energy of the k-th region of the preceding frame, $E_k$ is a speech log energy of the k-th region of the current frame, $\delta_{sk}(t)$ is a standard deviation value of the speech log energy of the k-th region of the current frame, $\gamma$ is a weighted value, and the maximum value of k is the number of regions into which the critical band of the received speech signal is divided.

12. The apparatus of claim 1, wherein if the current frame is determined as a noise segment, the noise threshold calculation unit is further adapted to calculate an average value and a standard deviation of the noise log energy for each of the plurality of regions of the frame and to update a signal threshold by using the calculated average value and standard deviation.

13. The apparatus of claim 12, wherein the noise threshold calculation unit is further adapted to calculate the noise threshold for each of the plurality of regions according to the mathematical expression $T_{nk}=\mu_{nk}+\beta_{nk}*\delta_{nk}$, wherein $\mu_{nk}$ is an average value of the noise log energy of the k-th region of the current frame, $\delta_{nk}$ is a standard deviation value of the noise log energy of the k-th region of the current frame, $\beta_{nk}$ is a hysteresis value of the k-th region of the current frame, $T_{nk}$ is a noise threshold of the k-th region of the current frame, and the maximum value of k is the number of regions into which the critical band of the received speech signal is divided.

14. The apparatus of claim 12, wherein the noise threshold calculation unit is further adapted to calculate the average value and standard deviation according to the mathematical expression:

$$\mu_{nk}(t)=\gamma*\mu_{nk}(t-1)+(1-\gamma)*E_k$$

$$[E_k^2]_{mean}(t)=\gamma*[E_k^2]_{mean}(t-1)+(1-\gamma)*E_k^2$$

$$\delta_{nk}(t)=\mathrm{root}([E_k^2]_{mean}(t)-[\mu_{nk}(t)]^2),$$

wherein $\mu_{nk}$(t−1) is an average value of the noise log energy of the k-th region of the preceding frame, $E_k$ is a noise log energy of the k-th region of the current frame, $\delta_{nk}$(t) is a standard deviation value of the noise log energy of the k-th region of the current frame, $\gamma$ is a weighted value, and the maximum value of k is the number of regions into which the critical band of the received speech signal is divided.

15. The apparatus of claim 1, wherein the segment discriminating unit is further adapted to calculate the log energy for of each of the plurality of regions.

16. The apparatus of claim 15, wherein the segment discriminating unit determines that the current frame is a speech segment if at least one of the plurality of regions has a log energy that is greater than a signal threshold.

17. The apparatus of claim 15, wherein the segment discriminating unit determines that the current frame is a noise segment if none of the plurality of regions has a log energy that is greater than a signal threshold and at least one of the plurality of regions has a log energy that is smaller than a noise threshold.

18. The apparatus of claim 15, wherein the segment discriminating unit is further adapted to apply determined segments of a preceding frame to the current frame if none of the plurality of regions has a log energy that is greater than a signal threshold or smaller than a noise threshold.

19. The apparatus of claim 1, wherein the segment discriminating unit is further adapted to determine whether a current frame of the speech signal is a noise segment or a speech segment according to the expression:

IF ($E_1>T_{s1}$ OR $E_2>T_{s2}$ OR $E_k>T_{sk}$), the frame is determined as a speech segment ELSE IF ($E_1<T_{n1}$ OR $E_2<T_{n2}$ OR $E_k<T_{nk}$), the frame is determined as a noise segment ELSE, the frame is determined as a noise segment or a speech segment according to the determination of a corresponding segment of a preceding frame, wherein E is a log energy for each of the plurality of regions, $T_s$ is a signal threshold for each of the plurality of regions, $T_n$ is a noise threshold for each of the plurality of regions, and k is the number of regions into which the critical band of the received speech signal is divided.

20. An apparatus for detecting speech segments of a speech signal, the apparatus comprising:

a user interface unit adapted to receive a user control command to initiate speech segment detection;

an input unit adapted to receive an input signal according to the user control command; and a processor adapted to format the input signal into a plurality of frames of a critical band, divide the critical band of each of the plurality of frames into a predetermined number of regions according to noise frequency characteristics, calculate a signal threshold and a noise threshold for each of the predetermined number of regions, based on a respective corresponding speech log enemy or a corresponding noise log enemy, compare a log energy of each of the predetermined number of regions to the corresponding signal threshold and noise threshold, and determine whether each of the plurality of frames is a speech segment or a noise segment according to the comparison.

21. The apparatus of claim 20, wherein the processor is further adapted to set the predetermined number of regions according to a type of a noise environment selected by the user.

22. The apparatus of claim 21, wherein the processor is further adapted to:

calculate an initial average value and an initial standard deviation of the log energy for each of the predetermined number of regions for a predetermined number of frames input at an initial stage; and calculate an initial signal threshold and an initial noise threshold using the initial average value and the initial standard deviation.

23. The apparatus of claim 20, wherein the processor is further adapted to determine whether the current frame is a speech segment or noise segment according to the expression:

IF ($E_1>T_{s1}$ OR $E_2>T_{s2}$ OR $E_k>T_{sk}$), the frame is determined as a speech segment ELSE IF ($E_1<T_{n1}$ OR $E_2<T_{n2}$ OR $E_k<T_{nk}$), the frame is determined as a noise segment ELSE, the frame is determined as a noise segment or a speech segment according to the determination of a corresponding segment of a preceding frame, wherein E is a log energy for each of the predetermined number of regions, $T_s$ is a signal threshold for each of the predetermined number of regions, $T_n$ is a noise threshold for each of the predetermined number of regions, and k is the predetermined number of regions.

24. The apparatus of claim 23, wherein if the current frame is determined as a noise segment, the processor is further adapted to calculate an average value and a standard deviation of the speech log energy for each of the predetermined number of regions of the frame and to update the signal threshold by using the calculated average value and standard deviation.

25. The apparatus of claim 23, wherein if the frame is determined to be a noise segment, the processor is further adapted to calculate an average value and a standard deviation of the noise log energy for each of the predetermined number of regions of the frame and to update the noise threshold by using the calculated average value and standard deviation.

26. A method for detecting speech segments of a speech signal, the method comprising:

dividing a critical band of an input signal into a predetermined number of regions according to noise frequency characteristics;

comparing a log energy calculated for each of the predetermined number of regions to a threshold set for each of the predetermined number of regions, wherein the threshold for each of the predetermined number of regions is calculated on a basis of a corresponding speech log energy or a corresponding noise log energy; and determining whether the input signal is a speech segment or a noise segment according to the comparison.

27. The method of claim 26, further comprising updating the threshold for each of the predetermined number of regions according to the result of the determination by using an average value and a standard deviation of the log energy calculated for each of the predetermined number of regions.

28. The method of claim 27, wherein the threshold for each of the predetermined number of regions comprises a signal threshold and a noise threshold.

29. The method of claim 27, further comprising updating the signal threshold for each of the predetermined number of regions by using the average value and standard deviation of the log energy calculated for each of the predetermined number of regions if the input signal is determined as a speech segment.

30. The method of claim 27, further comprising updating the noise threshold for each of the predetermined number of regions by using the average value and standard deviation of the log energy calculated for each of the predetermined number of regions if the input signal is determined as a noise segment.

31. The method of claim 26, further comprising:

calculating an initial average value and an initial standard deviation of the log energy for each of the predetermined number of regions for a predetermined number of frames input at an initial stage; and setting an initial threshold for each of the predetermined number of regions by using the initial average value and the initial standard deviation.

32. A method for detecting speech segments of a speech signal, the method comprising:

formatting the speech signal into a plurality of frames according to a critical band;

dividing a current frame of the speech signal into a predetermined number of regions according to noise frequency characteristics;

determining whether the current frame is a speech segment or a noise segment by comparing a log energy calculated for each of the predetermined number of regions with a corresponding signal threshold and a corresponding noise threshold; and updating the corresponding signal threshold or the corresponding noise threshold for each of the predetermined number of regions by using a corresponding speech log energy or a corresponding noise log energy for each of the predetermined number of regions.

33. The method of claim 32, wherein determining whether the current frame is a speech segment or a noise segment comprises comparing the log energy calculated for each of the predetermined number of regions to the signal threshold and the noise threshold for each of the predetermined number of regions.

34. The method of claim 33, wherein the current frame is determined as a speech segment if at least one of the predetermined number of regions has a log energy that is greater than the signal threshold.

35. The method of claim 33, wherein the current frame is determined as a noise segment if none of the predetermined number of regions has a log energy that is greater than the signal threshold and at least one of the predetermined number of regions has a log energy that is smaller than the noise threshold.

36. The method of claim 33, further comprising applying determined segments of a preceding frame to the current frame if none of the predetermined number of regions has a log energy that is greater than the signal threshold or smaller than the noise threshold.

37. The method of claim 33, further comprising setting an initial signal threshold and initial noise threshold for each of the predetermined number of regions by using an initial average value and an initial standard deviation of the log energy calculated for each of the predetermined number of regions for a predetermined number of frames input at an initial stage.

38. The method of claim 32, wherein the speech signal is formatted into four or five frames.

39. The method of claim 32, wherein the predetermined number of regions is two if the noise frequency characteristics correspond to car noise.

40. The method of claim 32, wherein the predetermined number of regions is three or four if the noise frequency characteristics correspond to peripheral noise generated when a user is walking.

41. The method of claim 32, wherein the predetermined number of regions is set according to a type of a noise environment selected by a user.

42. The method of claim 32, wherein determining whether the current frame is a speech segment or a noise segment comprises the expression:

IF ($E_1>T_{s1}$ OR $E_2>T_{s2}$ OR $E_k>T_{sk}$),), the frame is determined as speech segment ELSE IF ($E_1<T_{n1}$ OR $E_2<T_{n2}$ OR $E_k<T_{nk}$), the frame is determined as noise segment ELSE, the frame is determined as a noise segment or a speech segment according to the determination of a corresponding segment of a preceding frame, wherein E is a log energy for each of the predetermined number of regions, $T_s$ is a signal threshold for each of the predetermined number of regions, $T_n$ is a noise threshold for each of the predetermined number of regions, and k is the predetermined number of regions.

43. The method of claim 32, further comprising calculating an average value and a standard deviation of the speech log energy for each of the predetermined number of regions and updating a signal threshold for each of the predetermined number of regions if the frame is determined as a speech segment.

44. The method of claim 43, further comprising updating the signal threshold for each of the predetermined number of regions according to the mathematic expression:

$$T_{sk}=\mu_{sk}+\alpha_{sk}*\delta_{sk}$$

wherein μ is an average value of the speech log energy of the k-th predetermined region, δ is a standard deviation value of the speech log energy of the k-th predetermined region, α is a hysteresis value, $T_{sk}$ is a signal threshold, and the maximum value of k is the predetermined number of regions.

45. The method of claim 43, further comprising calculating the average value and standard deviation of each of the predetermined number of regions according to the mathematical expression:

$$\mu_{sk}(t)=\gamma*\mu_{sk}(t-1)+(1-\gamma)*E_k$$

$$[E_k^2]_{mean}(t)=\gamma*[E_k^2]_{mean}(t-1)+(1-\gamma)*E_k^2$$

$$\delta_{sk}(t)=\mathrm{root}([E_k^2]_{mean}(t)-[\mu_{sk}(t)]^2)$$

wherein $\mu_{sk}(t-1)$ is an average value of the speech log energy of the k-th predetermined region of a preceding frame, $E_k$ is a speech log energy of the k-th predetermined region of the current frame, $\delta_{sk}(t)$ is a standard deviation value of the speech log energy of the k-th predetermined region of the current frame, γ is a weighted value, and the maximum value of k is the predetermined number of regions.

46. The method of claim 32, further comprising calculating an average value and a standard deviation of the noise log energy for each of the predetermined number of regions and updating a noise threshold for each of the predetermined number of regions by using the calculated average value if the current frame is determined as a noise segment.

47. The method of claim 46, further comprising calculating the noise threshold for each of the predetermined number of regions according to the mathematical expression:

$$T_{nk}=\mu_{nk}+\beta_{nk}*\delta_{nk}$$

wherein μ is an average value of the noise log energy of the k-th predetermined region, δ is a standard deviation value of the noise log energy of the k-th predetermined region, $\beta_{nk}$ is a hysteresis value of the k-th predetermined region, $T_{nk}$ is a noise threshold, and the maximum value of k is the predetermined number of regions.

48. The method of claim 46, further comprising calculating the average value and standard deviation of each of the predetermined number of regions according to the mathematical expression:

$$\mu_{nk}(t)=\gamma*\mu_{nk}(t-1)+(1-\gamma)*E_k$$

$$[E_k^2]_{mean}(t)=\gamma*[E_k^2]_{mean}(t-1)+(1-\gamma)*E_k^2$$

$$\delta_{nk}(t)=\mathrm{root}([E_k^2]_{mean}(t)-[\mu_{nk}(t)]^2)$$

wherein $\mu_{nk}(t-1)$ is an average value of the noise log energy of the k-th predetermined region of a preceding frame, $E_k$ is a noise log energy of the k-th predetermined region of the current frame, $\delta_{nk}(t)$ is a standard deviation value of the noise log energy of the k-th predetermined region of the current frame, γ is a weighted value, and the maximum value of k is the predetermined number of regions.

* * * * *